US011576472B2

(12) United States Patent
Beck

(10) Patent No.: US 11,576,472 B2
(45) Date of Patent: Feb. 14, 2023

(54) INTERCHANGEABLE DECORATIVE ELEMENT SYSTEM

(71) Applicant: Catherine A. Beck, West Chester, PA (US)

(72) Inventor: Catherine A. Beck, West Chester, PA (US)

( * ) Notice: Subject to any disclaimer, the term of this patent is extended or adjusted under 35 U.S.C. 154(b) by 185 days.

(21) Appl. No.: 17/144,518

(22) Filed: Jan. 8, 2021

(65) Prior Publication Data

US 2022/0218079 A1 Jul. 14, 2022

(51) Int. Cl.
*A44C 17/02* (2006.01)
*A44C 9/00* (2006.01)

(52) U.S. Cl.
CPC ..... *A44C 17/0241* (2013.01); *A44C 9/0084* (2013.01)

(58) Field of Classification Search
CPC ..... A44C 17/0208; A44C 17/0216; A44C 17/022; A44C 17/0258; A44C 17/0266; A44C 9/00; A44C 9/0084; A44C 9/0053; A44C 13/00
USPC ..... 63/29.1, 30, 40
See application file for complete search history.

(56) References Cited

U.S. PATENT DOCUMENTS 1,457,196 A 5/1923 Stein
1,971,265 A 8/1934 King
2,519,152 A 8/1950 Piotrowski
4,374,470 A 2/1983 Isaacson
4,794,766 A 1/1989 Schunk et al.
4,796,442 A 1/1989 Sarcona
5,077,989 A 1/1992 Dillabaugh
5,343,718 A 9/1994 Poll
5,992,177 A 11/1999 Beard
6,067,818 A 5/2000 Winkler
6,490,886 B1 12/2002 Steinhauer et al.
6,508,079 B2 * 1/2003 Wolff ..... A44C 11/002 63/40
6,833,539 B1 12/2004 Maeda
9,516,931 B2 12/2016 Mencagli et al.
2004/0255620 A1 * 12/2004 Chuang ..... A44C 17/0208 63/29.1
2015/0257497 A1 * 9/2015 Nevatia ..... A44C 17/0208 63/40
2018/0098604 A1 * 4/2018 Beck ..... A44C 9/0053

* cited by examiner

*Primary Examiner* — Jack W Lavinder
(74) *Attorney, Agent, or Firm* — Panitch Schwarze Belisario & Nadel LLP

(57) ABSTRACT

An interchangeable decorative element system includes a decorative portion and a base portion. The decorative portion holds a decorative element and includes a plurality of studs. The base portion has a plurality of tracks, each of which has a guiding portion configured to be engaged by a respective stud of the decorative portion. In a first configuration, the decorative portion is aligned with the base portion, such that each of the decorative portion is received within the first end of the guiding portion of a respective track of the base portion. Rotation of the decorative portion in a first direction relative to the base portion causes each stud received within the first end of the guiding portion of each track to move along the guiding portion until the stud engages the respective catch, thereby transitioning the interchangeable decorative element system from the first position to a second, assembled position.

10 Claims, 4 Drawing Sheets

INTERCHANGEABLE DECORATIVE ELEMENT SYSTEM

BACKGROUND OF THE INVENTION

Embodiments of the present invention relate generally to an article, such as in the form of a ring, earrings, pendant necklace, brooch, bracelet pin, cuff links, buttons, clasp (e.g., on clothing, hats, purses, bags and the like), configured to interchangeably receive a decorative element.

Normally, a decorative element, for example a jewel or gemstone, is permanently secured within an article, such as a ring. Thus, a person wishing to vary the look of his or her jewelry, clothing, purse, bag and the like is forced to purchase multiple different items, which can be expensive, particularly when the setting is made from a precious metal, such as gold, silver, titanium, or the like. In addition, in the event that the decorative element is damaged, the jewelry, clothing, purse, bag and the like could not be salvage and would have to be wholly discarded.

It would therefore be desirable to provide a mechanism that allows for quick and easy replacement and interchangeability of a decorative element.

BRIEF SUMMARY OF THE INVENTION

An embodiment of the present invention relates to an interchangeable decorative element system comprising a decorative portion having a first side and an opposing second side, the first side being configured to hold a decorative element, the second side including a plate having a plurality of studs extending distally away from a surface of the plate, each stud including a shank connected to or formed integrally with the plate and a distal head, a diameter of the distal head of each shank being larger than a diameter of the shank; and a base portion having a plurality of first tracks, each first track having a guiding portion and an extension portion, the guiding portion having a first end of a first width and a second end of a second width, the first width being larger than the second width, a catch being formed at or proximate the second end of the guiding portion. In a first configuration of the interchangeable decorative element system, the decorative portion is aligned with the base portion, such that one stud of the plurality of studs of the decorative portion is received within the first end of the guiding portion of each first track of the base portion. Rotation of the decorative portion in a first direction relative to the base portion causes each stud received within the first end of the guiding portion of each first track to move along the guiding portion until the stud engages the respective catch, thereby transitioning the interchangeable decorative element system from the first position to a second position in which the decorative portion is assembled with the base portion.

BRIEF DESCRIPTION OF THE DRAWINGS

The following detailed description of preferred embodiments of the invention, will be better understood when read in conjunction with the appended drawings. For the purpose of illustration, there is shown in the drawings an embodiment which is presently preferred. It should be understood, however, that the invention is not limited to the precise arrangements and instrumentalities shown.

DETAILED DESCRIPTION OF THE INVENTION

Figure 1:
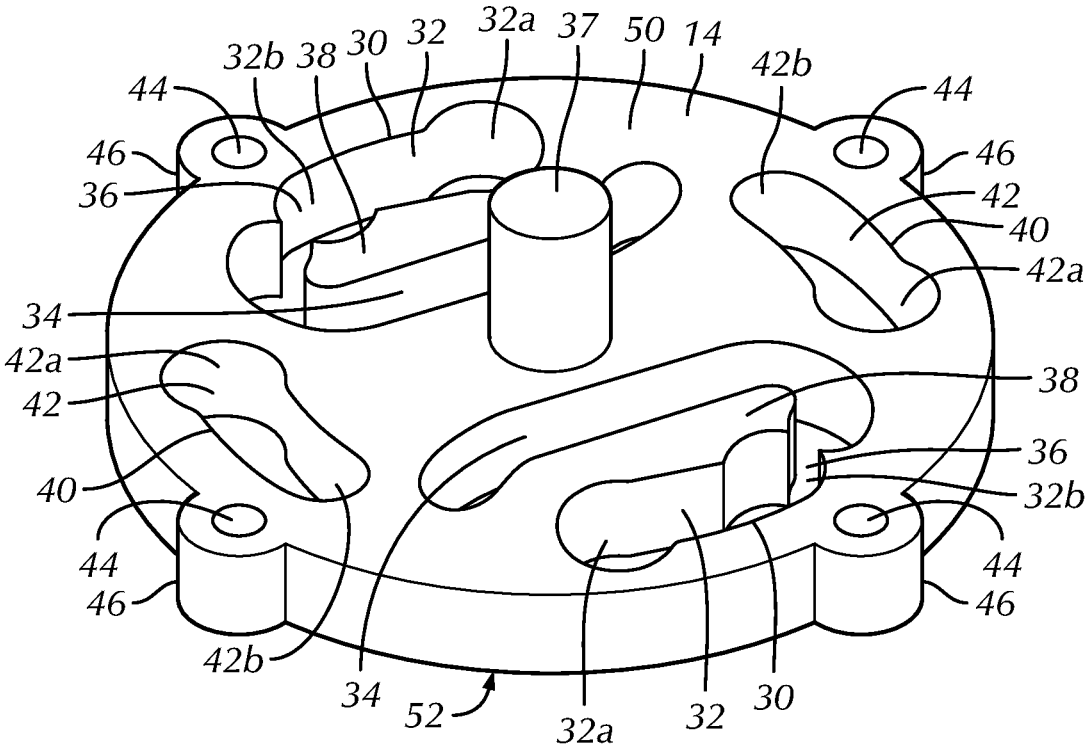
FIG. 1 is a perspective view of a base portion of the interchangeable decorative element system, in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the component and designated parts thereof. The terminology includes the above-listed words, derivatives thereof, and words of similar import. Additionally, the words "a" and "an" mean "at least one."

The description of the invention provided herein is in terms of jewelry, and particularly a ring. However, it will be understood by those skilled in the art that the description of the article and mechanism is equally applicable to any type of jewelry, clothing, bags and the like which include a decorative portion, such as, but not limited to, a jewel, gemstone, metallic decorative element and the like. For example, the present invention may be used for providing an interchangeable decorative element in a necklace pendant, an earring, a button, a brooch, a bracelet pin, a watch, cufflinks, a decorative clasp for a purse or bag and the like.

Referring to the drawings in detail, there is shown a preferred embodiment of a mechanism or system which enables interchangeability of a jewel, gem, precious stone or other type of decorative element 12. The system comprises a base portion 10 and a decorative portion 15.

Figure 4:
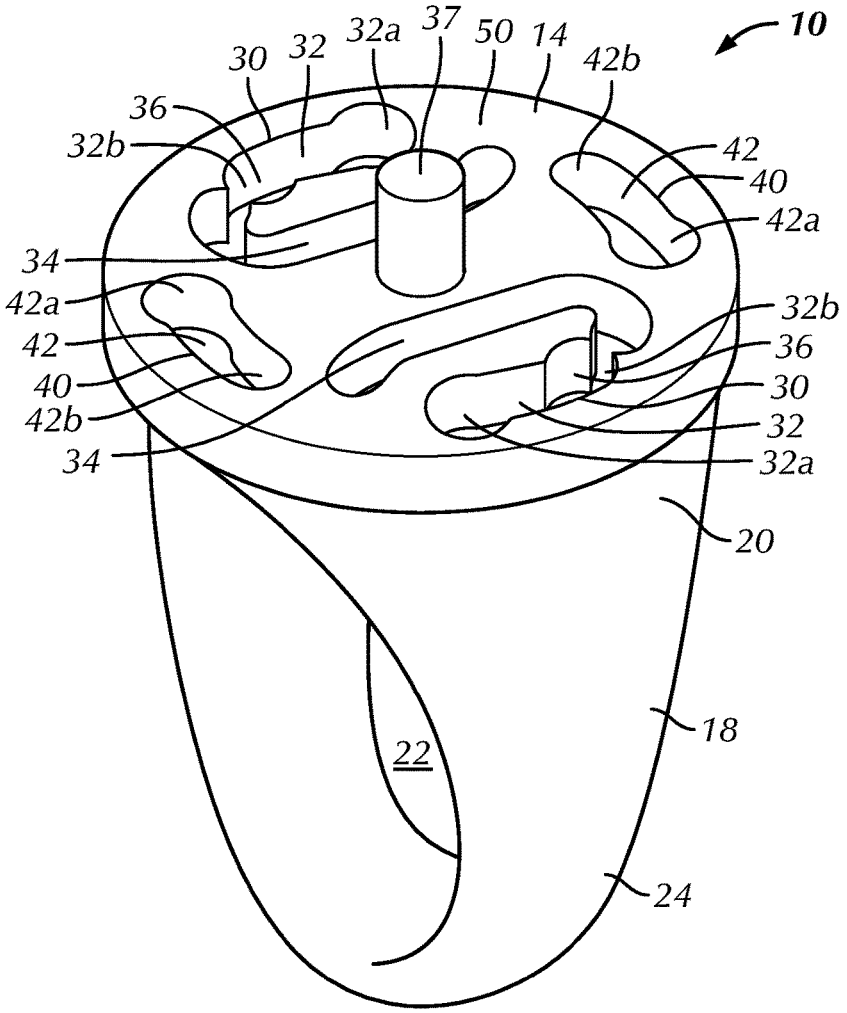
FIG. 4 is top perspective view of the base portion assembled with a ring base, in accordance with a preferred embodiment of the present invention.

Referring to FIGS. 1 and 4, the base portion 10 comprises a base plate 14 which is or is configured to be fixedly secured to or integrally formed with a setting, such as a ring body 18. The terms "base portion" and "base plate" are generally used interchangeably herein. Referring to FIG. 4, the ring body 18 includes mounting base 20 and a finger hole 22 through which the user extends his or her finger for wearing of the ring 10. The finger hole 22 is generally circular in shape but may be other shapes, as desired. An annular wall 24 which defines the finger hole 22 extends from an underside 26 of the mounting base 20.

The base plate 14 has a first or upper surface 50 and a second or lower surface 52. The base plate 14 is fixedly secured to or integrally formed with an upper side of the mounting base 20, such that the lower surface 52 of the base plate 14 contacts or engages the upper side of the mounting base 20. The base plate 14 may be secured to the mounting base 20 by a variety of securing mechanisms or processes, such as welding, soldering, adhesive, heat fusion, compression, interlocking fasteners, and the like. The base plate 14 is preferably made of a metal material, such as, but not limited to, aluminum, steel, sterling silver, tarnish resistant silver (e.g., argentium silver), gold, platinum, titanium, or the like, but it will be understood that the base plate 14 may be made of a polymeric or metal composite material.

In one embodiment, the mounting base 20 includes a plurality of posts (not shown) adapted to cooperate with apertures or recesses formed in the base plate 14, as will be described in further detail herein. Alternatively, the base plate 14 may be cast or molded with the ring body 18 (or any other type of setting) as an integral component thereof.

The base plate 14 includes at least one first track 30 and at least one second track 40. More preferably, the base plate 14 includes a plurality of first tracks 30 and a plurality of second tracks 40. In a preferred embodiment, a pair of the first tracks 30 are provided and are positioned diametrically opposite of each other, and a pair of the second tracks 40 are provided and are position diametrically opposite of each other.

In a preferred embodiment, each first track 30 has a L-shaped, C-shaped, V-shaped or U-shaped profile, and more preferably a U-shaped profile. Each first track 30 includes a guiding portion 32 and an extension portion 34. The guiding portion 32 is configured to receive a corresponding stud 68 of the top plate 16, as will be described in more detailed herein. The guiding portion 32 has a first end 32*a* and an opposing second end 32*b*. At, proximate or adjacent to the second end 32*b* of the guiding portion 32, an inwardly extending catch 36 is formed. A width of the first end 32*a* of the guiding portion 32*a* is greater than a width of a reminder of the guiding portion 32.

A strip of material of the base plate 14 extends between the guiding portion 32 and the extension portion 34. The strip of material is a cantilevered and flexible arm 38 which can be deformed by the stud 68 as the stud 68 travels along the length of the guiding portion 32.

Each second track 40 preferably has a generally linear or slightly curved profile. Each second track 40 is formed of a guiding portion 42 having a first end 42*a* and an opposing second end 42*b*. Each guiding portion 42 of the second tracks 40 is configured to receive a corresponding stud 68 of the top plate 14, as described in greater detail herein. A width of the first end 42*a* of each guiding portion 42 is greater than a width of a reminder of the guiding portion 42.

The base plate 14 further includes a post 37 formed at a geometric center thereof. The post 37 extends distally away from the first surface 50 of the base plate 14. The post 37 has a generally cylindrical shape.

In one embodiment, as shown in FIG. 1, a plurality of spaced-apart apertures 44 are formed on the periphery of the base plate 14. In one embodiment, each aperture 44 is formed in a protrusion 46 which juts out from the peripheral edge of the base plate 14. Each aperture 44 is configured to receive a corresponding post (not shown) formed on the mounting base 20. To secure the base plate 14 to the mounting base 20, the components are aligned with each other such that the posts of the mounting base 20 are received within the peripheral apertures 44 of the base plate 14, and then the components are soldered (or otherwise secured) together in the areas of the engaged posts and peripheral apertures 44. Referring to FIG. 4, there is shown an example of the base plate 14 secured to the mounting base 20 of a ring body 18.

However, it will be understood by the skilled artisan that the base plate 14 may be secured to the mounting base 20 by a variety of other mechanisms, such that the corresponding structures of the peripheral apertures 44 and posts need not be included, and may even be cast or molded with the mounting base 20.

Again, a ring is just one example of the type of jewelry with which the present invention may be utilized. If the system were utilized with, for example, a necklace pendant, the base plate 14 would be fixedly secured to or integrally formed with a mounting base of the pendant. If the system were utilized with, for example, a purse clasp, the base plate 14 would be fixedly secured to or integrally formed with a mounting base of the clasp.

Figure 2:
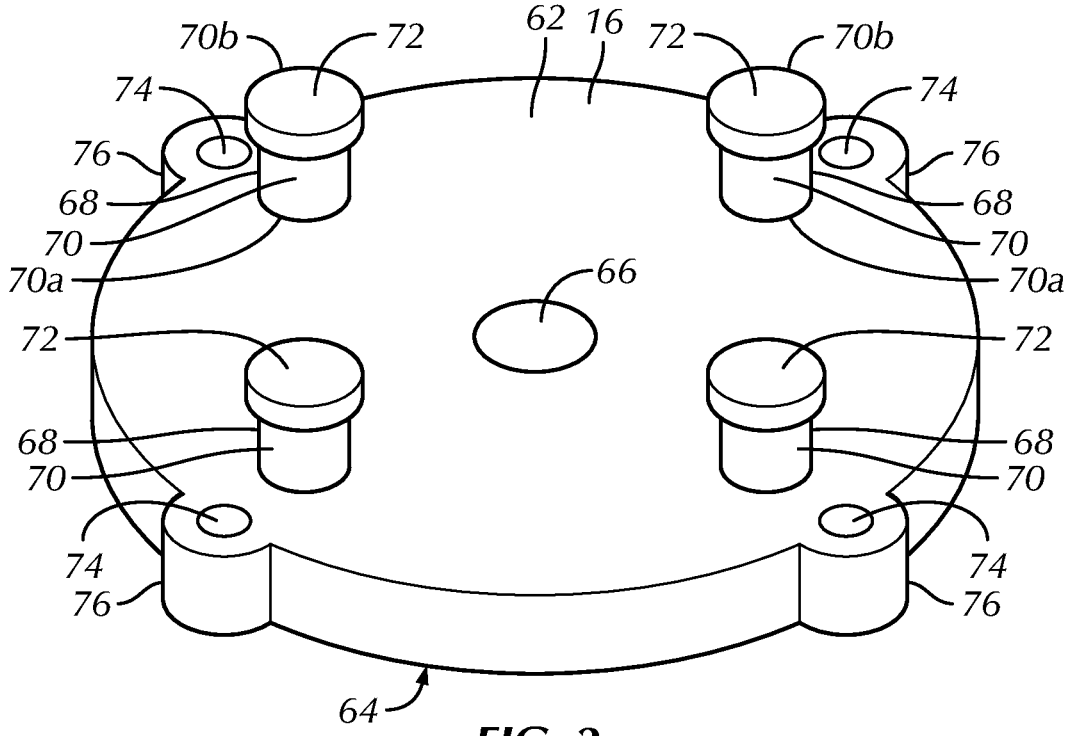
FIG. 2 is a perspective view of a plate component of a decorative portion of the interchangeable decorative element system, in accordance with a preferred embodiment of the present invention.
Figure 3:
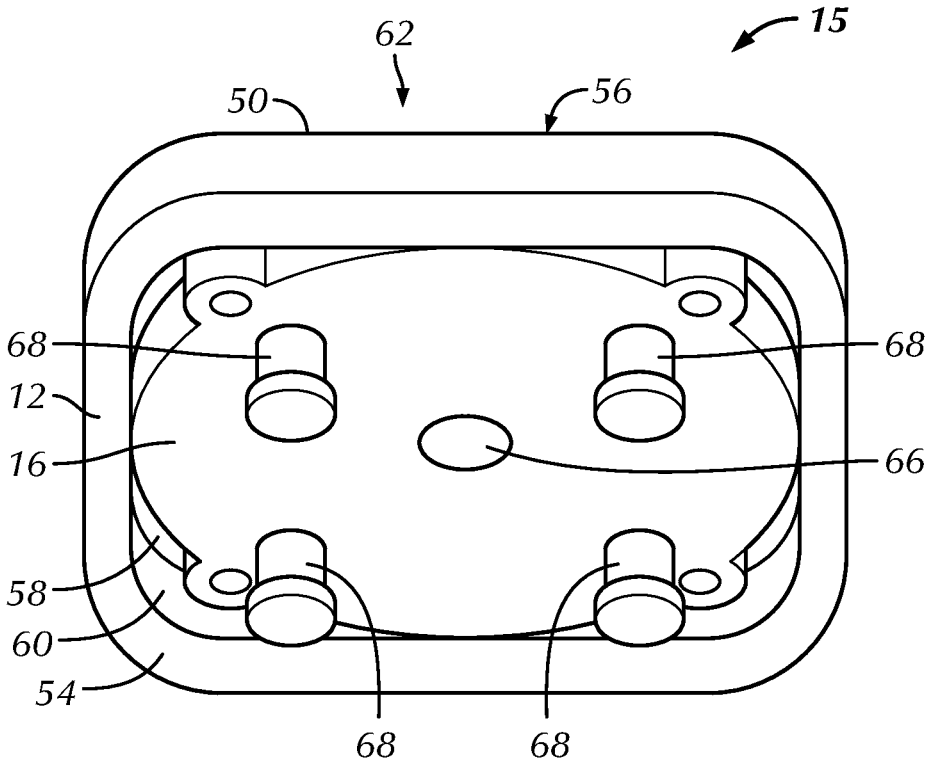
FIG. 3 is a bottom perspective view of the decorative portion, in accordance with a preferred embodiment of the present invention.
Figure 5:
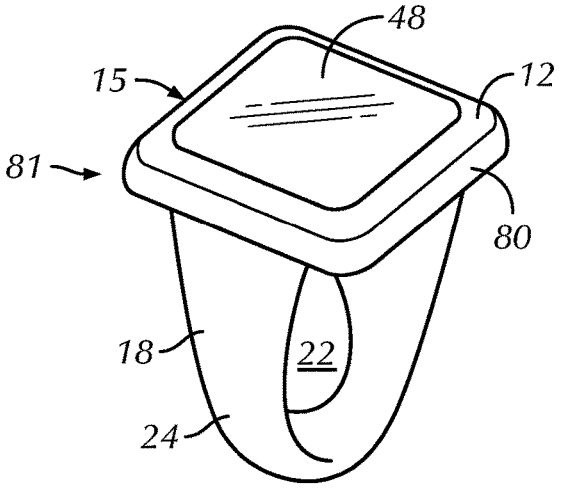
FIG. 5 is a side perspective view of an assembled ring including the base portion and decorative portion shown in FIGS. 1-2.

Referring to FIGS. 3 and 5, the decorative portion 15 comprises a bezel 50 configured to hold a decorative element 12. In one embodiment, the decorative element 12 includes a jewel or stone 48 (FIG. 5). The decorative portion 15, and more particularly, the bezel 50 has a first side 56 configured to receive and hold the decorative element 12 and an opposing second side 58 provided with a cover plate 16. More particularly, on its upper side corresponding to the first side 56, the bezel 50 preferably includes a cavity 55 configured to receive and hold the jewel 48. The cavity 55 is shown only in FIG. 6B in the context of the second embodiment, but it will be understood that a similar cavity would be included in the bezel 50 of the embodiment of FIGS. 1-5. The decorative element 12 may be fixed within and/or on the bezel 50 by way of a friction fit, mechanical fastener, adhesive, or other methods well known to those of ordinary skill in the art to secure precious in a jewelry setting. The bezel 50 is preferably made from a metal, such as, but not limited to, sterling silver, tarnish resistant silver (e.g., argentium silver), gold, platinum, titanium, or the like, and may be plated with rhodium or the like. The bezel 50 also protects the edges of the jewel 48 from contact with other components of the article (e.g., a ring or pendant), which may cause wear or damage to the jewel 48.

Referring to FIG. 3, the underside of the bezel 50, corresponding to the second side 58, preferably includes a wall 54 which extends around a periphery of the bezel 50 and defines therein a cavity 60 configured to receive the cover plate 16.

Referring to FIGS. 2-3, the cover plate 16 has a first surface 62 and an opposing second surface 64. The cover plate 16 is fixedly secured to or integrally formed in the cavity 60 formed on the underside of the bezel 50, such that the second surface 64 of the cover plate 16 contacts or engages the lower surface 58 of the bezel 50. The cover plate 16 may be secured to the bezel 50 by a variety of securing mechanisms or processes, such as welding, soldering, adhesive, heat fusion, compression, interlocking fasteners, and the like. The cover plate 16 is preferably made of a metal material, such as such as, but not limited to, aluminum, steel, sterling silver, tarnish resistant silver (e.g., argentium silver), gold, platinum, titanium, or the like, but may be made of another material, such as a polymeric or metal composite material.

In one embodiment, within the cavity 60, there are formed a plurality of posts (not shown) adapted to cooperate with apertures or recesses formed in the cover plate 16, as will be described in further detail herein. Alternatively, the cover plate 16 may be cast or molded with the underside of the bezel 50 as an integral component thereof.

The cover plate 16 preferably includes an opening 66 formed at its geometric center. The opening 66 is configured to receive therein the post 37 extending from the first surface 50 of the base plate 14. As such, the opening 66 has a shape that corresponds to the shape of the post 37, preferably a generally cylindrical shape, and has a diameter that is just slightly larger than a diameter of the post 37, such that the post 37 can be received within the opening 66 in an assembled configuration of the system.

The cover plate 16 preferably includes a plurality of studs 68 extending distally away from the first surface 62 and dispersed around the central opening 66. Each stud 68 is formed by a shank 70 and a head 72. Each stud 68 has a first, proximal end 70*a* where the shank 70 is connected to or formed integrally with the top plate 16 and an opposing second end 70*b* provided with the head 72. The distal head 72 of each stud 68 has a diameter that is larger than a diameter of the shank 70. The distal head 72 of each stud 68 may a plate-like form of a certain thickness, or may more simply be in the form of a flattened boss.

Preferably, one pair of the studs 68 are provided at positions of the cover plate 16 which correspond to the locations of the first ends 32*a* of the guiding portions 32 of the first tracks 30 of the bottom plate 14, and a second pair of the studs 68 are provided at positions of the cover plate 16 which correspond to the locations of the first ends 42*a* of the guiding portions 42 of the second tracks 40. The diameter of the head 72 of each stud 68 of the first pair of studs 68 is slightly smaller than the width of the first end 32*a* of the guiding portion 32 of the respective first track 30, but at least slight greater than the width of a reminder of the guiding portion 32. The diameter of the shank 70 of each stud 68 of the first pair of studs 68 is slightly smaller than the width of the remainder of the guiding portion 32, such that the shank 70 of each stud 68 is slidable along the guiding portion 32. As such, the head 72 of each stud 68 of the first pair of studs 68 is sized to pass through the opening formed by the first end 32*a* of the guiding portion 32 of a corresponding first track 30, but as the stud 68 travels along the length of the guiding portion 32 from the first end 32*a* toward the second end 32*b*, the shank 70 is slidable along the track 30, but the stud 68 cannot be removed from the track 30, since the diameter of the head 72 is greater than the width of the remainder of the guiding portion 32.

The diameter of the head 72 of each stud 68 of the second pair of studs 68 is slightly smaller than the width of the first end 42*a* of the guiding portion 42 of the respective second track 40, but at least slight greater than a width of a reminder of the guiding portion 42. The diameter of the shank 70 of each stud 68 of the second pair of studs 68 is slightly smaller than the width of the remainder of the guiding portion 42. As such, the head 72 of each stud 68 of the second pair of studs 68 is sized to pass through the opening formed by the first end 42*a* of the guiding portion 42 of a corresponding second track 40, but as the stud 68 moves along the length of the guiding portion 42 from the first end 42*a* toward the second end 42*b*, the shank 40 is slidable along the track 40, but the stud 68 cannot be removed from the track 70, since the diameter of the head 72 is greater than the width of the remainder of the guiding portion 42.

In one embodiment, as shown in FIG. 2, a plurality of spaced-apart apertures 74 are formed on the periphery of the cover plate 16. In one embodiment, each aperture 74 is formed in a protrusion 76 which juts out from the peripheral edge of the cover plate 16. The position of each aperture 74 and peripheral protrusion 76 of the cover plate 16 corresponds to a respective one of the apertures 44 and peripheral protrusions 46 of the base plate 14. Each aperture 74 is configured to receive a corresponding post (not shown) on the underside of the bezel 50. To secure the cover plate 16 to the underside of the bezel 50, the components are aligned with each other such that the posts extending from the lower surface 58 of the bezel 50 are received within the peripheral apertures 74 of the cover plate 16, and then the components are soldered (or otherwise secured) together in the areas of the engaged posts and peripheral apertures 74. Referring to FIG. 3, there is shown an example of the cover plate 16 secured to the underside of a bezel 50 of a decorative element 12.

However, it will be understood by the skilled artisan that the cover plate 16 may be secured to the bezel 50 by a variety of other mechanisms, such that the corresponding structures of the peripheral apertures 74 and posts need not be included, and may even be cast or molded with the bezel 50.

It will also be understood by the skilled artisan that the cover plate 16 and the baes plate 14 may be exchanged for each other. That is, the cover plate 16 may be provided on the base portion 10 and the base plate 14 may be provided on the decorative portion 15.

Again, a ring is just one example of the type of jewelry with which the present invention may be utilized. If the system were utilized with, for example, a necklace pendant, the top plate 16 would be fixedly secured to or integrally formed with the underside of the bezel of the pendant. If the system were utilized with, for example, a purse clasp, the top plate 16 would be fixedly secured to or integrally formed with the underside of the bezel of the clasp.

Referring again to the example of a ring, as shown in FIGS. 3 and 5, the decorative element 12 preferably further includes a halo 80. The halo 80 includes a peripheral wall 81 surrounding an opening 83. At least a portion of the jewel 48 is received within the opening 83. As such, the halo 80 surrounds the jewel 48. It will be understood by those skilled in the art that the decorative portion 15, and particularly the bezel 50 and jewel 48, and the halo 80 are not limited to any particular shape, but rather may have any suitable shape, such as a circle, oval, a rectangle, a square, a pear, a teardrop and the like. This is because the cover plate 16 provided on the underside of the bezel 50 is generally circular so as to rotate about and engage with the base plate 14 as discussed herein.

In one embodiment, as shown in FIGS. 3 and 5, the halo 80 is fixedly secured to the upper side 56 of the bezel 50, also known as a crown, such that the halo 80 cannot be removed from the decorative element 12, and more particularly from the bezel 50 and jewel 48.

The ring base 18, bezel 50 and halo 80 are all preferably made from a precious metal, such as gold, silver, tarnish resistant silver (e.g., argentium silver), titanium, platinum, or the like, and are preferably made from the same material to provide the look of a conventional ring. In addition, the ring base 18, bezel 50 and/or halo 80 may, in some circumstances be plated, such as with rhodium or the like, to prevent tarnishing. The halo 80 also preferably includes a decorative design, which may be in the form of a raised or etched pattern (not shown) molded or welded on a visible surface of the halo 80, additional jewels (not shown) attached to the visible surface of the halo 80, or the like. Designs or patterns (not shown) may also be formed on a visible surface of the bezel 50 and/or ring base 18.

Figure 6A:
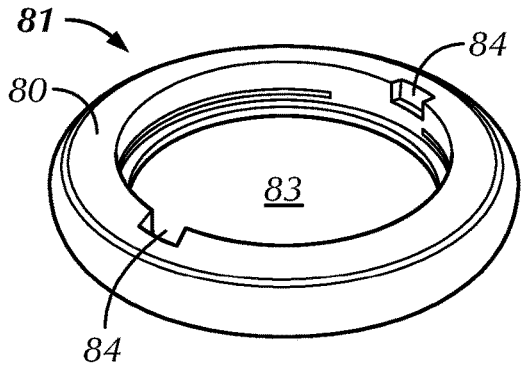
FIG. 6A is a side perspective view of a separate halo component of the interchangeable decorative element system, in accordance with a second preferred embodiment of the present invention.
Figure 6B:
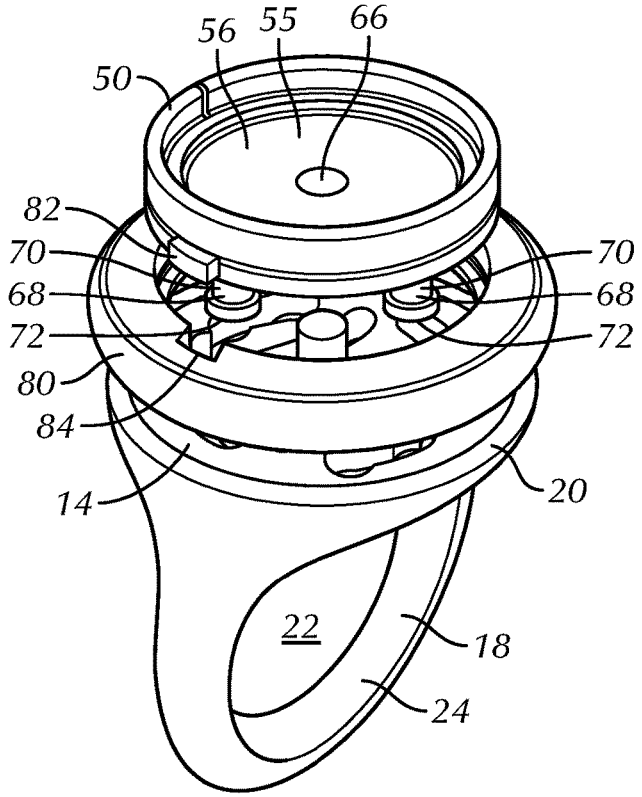
FIG. 6B is an exploded view of the interchangeable decorative element system, in accordance with the second preferred embodiment of the present invention, but with the decorative element missing.
Figure 6C:
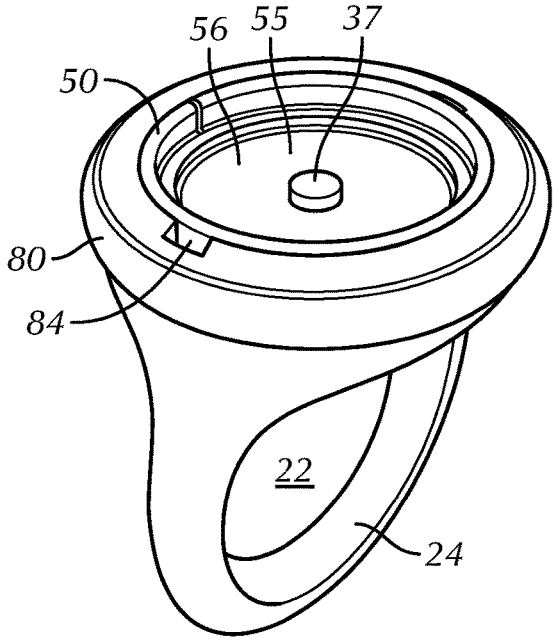
FIG. 6C is a perspective view of an assembled configuration of the interchangeable decorative element system, in accordance with the second preferred embodiment of the present invention, but with the decorative element missing.

In another embodiment, as shown in FIGS. 6A-6C, the decorative element 12 includes a removable halo 80. That is, the halo 80 is removable from the bezel 50. In the embodiment of FIGS. 6A-6C, the bezel 50 includes at least one tongue 82 protruding outwardly from a sidewall of the bezel 50 and the halo 80 includes at least one notch 84 positioned and configured to receive the tongue 82. Preferably, the bezel 50 includes a plurality of tongues 82 protruding outwardly from the sidewall of the bezel 50 and the halo 80 includes a plurality of notches 84 positioned and configured to receive one of tongues 82. More preferably, the bezel 50 includes a pair of tongues 82 which are positioned diametrically opposite of each other and the halo 80 includes a pair of notches 84 similarly positioned diametrically opposite of each other. Upon mating of the notches 84 and tongues 82, the halo 80 is rotatable with the bezel 50, while the decorative element 12 is being attached to the setting (e.g., the ring base 18), as will be described in more detail below.

Referring to FIGS. 1-5, in this first embodiment, to assemble the decorative portion 15 with the base portion 10, the decorative portion 15 is brought into engagement with the base portion 10 in a first configuration. In this first configuration, for example in the context of a ring, the decorative portion 15 is placed atop the base portion 10. In this first configuration, the decorative portion 15 and the base portion 10 are aligned with one another, such that one stud 68 of the plurality of studs 68 of the decorative portion 15 is received within the opening formed at the first end 32*a* of the guiding portion 32 of each first track 30 of the base portion 10. Preferably, in the first configuration, one stud 68 of the plurality of studs 68 of the decorative portion 15 is also received within the opening formed at the first end 42*a* of the guiding portion 42 of each second track 40 of the base portion 10. Also, in the first configuration, the post 37 of the base plate 14 is preferably received within the central opening 66 of the cover plate 16.

Next, to transition the system to a second, assembled configuration, the user rotates the decorative portion 15 in a first direction, for example a counter-clockwise direction, relative to the base portion 10. The rotation of the decorative portion 15 in the first direction causes each stud 68 received in each first track 30 to move along the guiding portion 32 until the stud 68 passes the respective catch 36 of that track 30. The flexible arms 38 facilitate movement of the studs 68 within the guiding portions 32 of the first tracks. In this second configuration, the decorative portion 15 becomes assembled with the base portion 10 by the engagement of the studs 68 and the catches 36, and the engagement of the studs 68 and the catches 36 prevent unintentional removal of the decorative portion 15 from the base portion 10. The rotation of the decorative portion 15 also causes each stud 68 received in each second track 40 to move along the guiding portion 42 from the first end 42*a* toward the second end 42*b*, preferably until the stud 68 bottoms out against the second end 42*b*. The inclusion of the second tracks 40 and the studs 68 to be received therein relieves some of the tension which is exerted on the first tracks 30 by the movement of the studs 68 therein upon rotation of the decorative portion 15.

To disassemble the decorative portion 15 from the base portion 10, for example, in order to assemble a new decorative portion 15 having a different jewel 48 or appearance to the base portion 10, the user rotates the decorative portion 15 in a second direction opposite to the first direction, while simultaneously applying a degree of force, relative to the base portion 10. The torque applied to the decorative portion 15 in the second direction causes each stud 68 to pass back over the respective catch 36 of the respective first track 30 and each stud 68 then moves along the guiding portion 32 toward the first end 32*a* of the guiding portion 32, preferably until the stud 68 bottoms out against the first end 32*a*. Again, the flexible arms 38 facilitate movement of the studs 68 within the guiding portions 32 of the first tracks. The rotation of the decorative portion 15 also causes each stud 68 received in each second track 40 to move along the guiding portion 42 from the second end 42*b* toward the first end 42*a*, preferably until the stud 68 bottoms out against the first end 42*a*. Then, the decorative portion 15 may be lifted from the base portion 10 for changing of the decorative portion 15.

Referring to FIGS. 6A-6C, in this second embodiment, the halo 80 and bezel 50, preferably holding the jewel 48, are assembled together by aligning the components such that each projecting tongue 82 of the bezel 50 is received within a respective notch 84 formed in the halo 80. So assembled, the components form the decorative portion 15, which may then be assembled with and disassembled from the base portion 10 in the same manner as described above with respect to FIGS. 1-5. The mating of the tongue(s) 82 and notch(es) 84 secures the halo 80 to the base portion 10, but ensures that the halo 80 rotates with the bezel 50 in both the first and second directions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An interchangeable decorative element system comprising:

a decorative portion having a first side and an opposing second side, the first side being configured to hold a decorative element, the second side including a plate having a plurality of studs extending distally away from a surface of the plate, each stud including a shank connected to or formed integrally with the plate and a distal head, a diameter of the distal head of each shank being larger than a diameter of the shank; and a base portion having a plurality of first tracks and a plurality of second tracks, each first track having a guiding portion and an extension portion, the guiding portion having a first end of a first width and a second end of a second width, the first width being larger than the second width, a catch being formed at or proximate the second end of the guiding portion, and each second track having a generally linear or slightly curved profile, wherein in a first configuration of the interchangeable decorative element system, the decorative portion is aligned with the base portion, such that one stud of the plurality of studs of the decorative portion is received within the first end of the guiding portion of each first track of the base portion and one stud of the plurality of studs of the decorative portion is received within a first end of each second track of the base portion, a width of the first end of each second track being larger than a width of an opposing second end of each second track; and, wherein rotation of the decorative portion in a first direction relative to the base portion causes each stud received within the first end of the guiding portion of each first track to move along the guiding portion until the stud engages the respective catch, thereby transitioning the interchangeable decorative element system from the first position to a second position in which the decorative portion is assembled with the base portion.

2. The interchangeable decorative element system according to claim 1, wherein the plurality of first track includes two first tracks which are positioned opposite of each other.

3. The interchangeable decorative element system according to claim 1, wherein each first track has a U-shaped profile.

4. The interchangeable decorative element system according to claim 1, wherein rotation of the decorative portion in the first direction relative to the base portion causes each stud received within the first end of each second track to slide from the first end toward the opposing second end of each second track.

5. The interchangeable decorative element system according to claim 1, wherein the decorative portion includes a bezel, the decorative element being secured on and/or within the bezel.

6. The interchangeable decorative element system according to claim 1, wherein the decorative portion comprises a crown formed of a halo integrally formed with the decorative element.

7. The interchangeable decorative element system according to claim 1, wherein the decorative portion comprises a removable halo.

8. The interchangeable decorative element system according to claim 7, wherein the decorative portion includes a bezel having at least one tongue protruding from a periphery thereof, and wherein the removable halo includes at least one notch, wherein in the first position of the interchangeable decorative element system, the at least one tongue of the bezel is received with the at least one notch and the removable halo is rotatable with the decorative portion.

9. The interchangeable decorative element system according to claim 1, wherein each of the cover plate and the base portion is made from a metal.

10. An interchangeable decorative element system comprising:

a decorative portion having a first side and an opposing second side, the first side being configured to hold a decorative element, the second side including a plate having a plurality of studs extending distally away from a surface of the plate, each stud including a shank connected to or formed integrally with the plate and a distal head, a diameter of the distal head of each shank being larger than a diameter of the shank; and a base portion having a plurality of first tracks, each first track having a guiding portion and an extension portion, the guiding portion having a first end of a first width and a second end of a second width, the first width being larger than the second width, a catch being formed at or proximate the second end of the guiding portion, wherein in a first configuration of the interchangeable decorative element system, the decorative portion is aligned with the base portion, such that one stud of the plurality of studs of the decorative portion is received within the first end of the guiding portion of each first track of the base portion;

wherein rotation of the decorative portion in a first direction relative to the base portion causes each stud received within the first end of the guiding portion of each first track to move along the guiding portion until the stud engages the respective catch, thereby transitioning the interchangeable decorative element system from the first position to a second position in which the decorative portion is assembled with the base portion, and wherein the base portion further includes a central post and the plate of the decorative portion further includes a central opening configured to receive the central post of the base portion.

* * * * *